US006309252B1

(12) United States Patent
Murakami et al.

(10) Patent No.: US 6,309,252 B1
(45) Date of Patent: Oct. 30, 2001

(54) WATERPROOF CONNECTOR

(75) Inventors: Takao Murakami; Masaru Fukuda, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/327,452

(22) Filed: Jun. 8, 1999

(30) Foreign Application Priority Data

Jun. 12, 1998 (JP) ..... 10-165552

(51) Int. Cl.[7] ..... H01R 13/40
(52) U.S. Cl. ..... 439/587; 439/274
(58) Field of Search ..... 439/587, 589, 439/274, 275, 279, 280

(56) References Cited

U.S. PATENT DOCUMENTS

| | | | | |
|---|---|---|---|---|
| 5,266,045 | * | 11/1993 | Yamamoto et al. | 439/587 |
| 5,299,949 | * | 4/1994 | Fortin | 439/589 |
| 5,551,892 | * | 9/1996 | Endo et al. | 439/589 |
| 5,707,251 | | 1/1998 | Sakai et al. | 439/589 |
| 5,782,657 | * | 7/1998 | Wolla et al. | 439/595 |

FOREIGN PATENT DOCUMENTS

| | | | |
|---|---|---|---|
| 2 753 008 | 3/1998 | (FR) | H01R/13/514 |
| 62-188069 | 11/1987 | (JP) . | |
| 7-122331 | 5/1995 | (JP) . | |
| WO 92 15133 | 9/1992 | (WO) | H01R/13/92 |
| WO 9632760 | 10/1996 | (WO) | H01R/13/436 |
| WO 97 36346 | 10/1997 | (WO) | H01R/13/52 |

* cited by examiner

*Primary Examiner*—Tulsidas Patel
(74) *Attorney, Agent, or Firm*—Finnegan, Hendeson, Farabow, Garrett & Dunner, L.L.P.

(57) ABSTRACT

A waterproof connector includes: a connector housing formed with a plurality of terminal housing chambers and further formed with a plurality of rubber tap housing concave sections which are formed in positions facing the terminal housing chambers; and rubber taps to be pressedly inserted respectively into the plural rubber tap housing concave sections which are formed with electric wire insertion through holes into which the electric wires are inserted. In the construction, when the rubber taps are pressedly inserted respectively into the rubber tap housing concave sections, the electric wire insertion through holes of the rubber taps are blocked up.

4 Claims, 4 Drawing Sheets

WATERPROOF CONNECTOR

BACKGROUND OF THE INVENTION

1. Field of the Invention

The present invention relates to a multiple waterproof connector which improves waterproofness between a connector housing and plural electric wires with which terminals are connected and does not require a dummy tap.

2. Description of Related Art

As such a dummy tap for this type of the waterproof connector, a dummy tap shown in FIGS. 1 and 2 is disclosed in Japanese Utility Model Application Laid-Open No. 62-188069, and a dummy tap shown in FIGS. 3 and 4 is disclosed in Japanese Patent Application Laid-Open No. 7-122331.

A dummy tap A for a waterproof connector shown in FIGS. 1 and 2 is composed of a pin 5 made of synthetic resin having a bar-shaped section 5*a* and disk-shaped step section 5*b*, and a circular rubber tap 6 into which the bar-shaped section 5*a* of the pin 5 is fitted. Moreover, a plurality of terminal housing holes 2 are formed in a connector housing 1 of a waterproof connector, and a female terminal 4 which is connected with an electric wire 3 is engaged with by a lance (flexible engagement arm) 1*a* so as to be housed in each terminal housing hole 2.

As shown in FIG. 2, the dummy tap A is fitted into a base end side of the free terminal housing hole 2 of the connector housing 1 of the waterproof connector so that water is prevented from penetrating the terminal housing hole 2 from the outside.

A dummy tap B for the waterproof connector shown in FIGS. 3 and 4 is composed of a rubber tap 7 for sealing an electric wire which is fitted into a free terminal housing hole 2 of plural terminal housing holes 2 formed in a connector housing 1' of a waterproof connector into which a female terminal is not mounted, and a rear holder 8 made of synthetic resin, which has a shaft section 8*a* whose diameter is equal to a diameter of an electric wire 3 and which is inserted into an electric wire insertion hole 7*a* of the rubber tap 7.

As shown in FIG. 4, when a frame-shaped lock section 8*b* of the rear holder 8 is engaged with the connector housing 1', the dummy tap B is fitted into the free terminal housing hole 2 of the connector housing 1' and is locked so that water is prevented from penetrating the terminal housing hole 2 from the outside.

The conventional connector housings 1 and 1' of the water proof connector have the plural terminal housing holes 2 respectively, but some terminal housing holes 2 are not used because of an improvement or disuse of an option circuit (namely, variations of a wire harness circuit is used in common). For this reason, the rear holder 8 of the dummy tap A or dummy tap B is indispensable, and thus a number of parts is increased and the cost becomes high.

In addition, since the variation of application or the like of the waterproof connectors is diversified, in the case where free terminal housing holes 2 of the connector housings 1 and 1' are changed to be used, parts should be replaced with another ones.

SUMMARY OF THE INVENTION

The present invention has been achieved with such points in view. It therefore is an object of the invention to provide a multiple waterproof connector which does not require a dummy tap and thus can reduce a number of parts and can lower total cost.

A first aspect of the invention provides a waterproof connector comprising: a connector housing where a plurality of terminal housing chambers are formed, the terminal housing chambers being housing chambers into which terminals connected with electric wires are to be inserted, the connector housing being further formed with a plurality of rubber tap housing concave sections, the rubber tap housing concave sections being formed in positions facing the terminal housing chambers; and rubber taps being to be pressedly inserted respectively into the plural rubber tap housing concave sections, the rubber taps being formed with electric wire insertion through holes into which the electric wires are inserted, wherein when the rubber taps are pressedly inserted respectively into the rubber tap housing concave sections, the electric wire insertion through holes of the rubber taps are blocked up.

Since this waterproof connector does not require a dummy tap, a number of parts is reduced and the cost is lowered. Moreover, since the electric wire insertion hole of the rubber tap into which the electric wire is not inserted is blocked up by the rubber tap which is pressedly inserted into the rubber tap housing concave section, water is prevented from penetrating from the outside, and thus waterproofness of the rubber taps is obtained easily and securely.

A second aspect of the invention provides a waterproof connector according to the first aspect comprising: wherein a circular concave section and a circular convex section are formed alternatively and integrally with the electric wire insertion through hole of the rubber tap; wherein when the rubber tap is pressedly inserted into the rubber tap housing concave section, the circular convex section is blocked up, thereby blocking up the electric wire insertion through hole; and wherein when the electric wire is going to be inserted through the electric wire insertion through hole of the rubber tap, the electric wire is guided into the circular concave section so as to spread out the circular convex section, so that the electric wire is inserted through the electric wire insertion through hole.

A third aspect of the invention provides a waterproof connector according to the second aspect wherein a conical surface is formed at one end of the rubber tap.

A fourth aspect of the invention provides a waterproof connector according to the third aspect wherein a reverse conical surface is formed on an inlet side of the rubber tap housing concave section.

In the waterproof connector of the second through fourth aspects, even if the wiring paths of the electric wires in the connector housing are changed later, the circular concave section of the electric wire insertion hole of the rubber tap guides the insertion of the electric wire into the electric wire insertion hole. For this reason, the electric wire can be inserted through the electric wire insertion hole of the rubber tap easily without replacing the parts, and thus the application or the like of the waterproof connector is further diversified.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
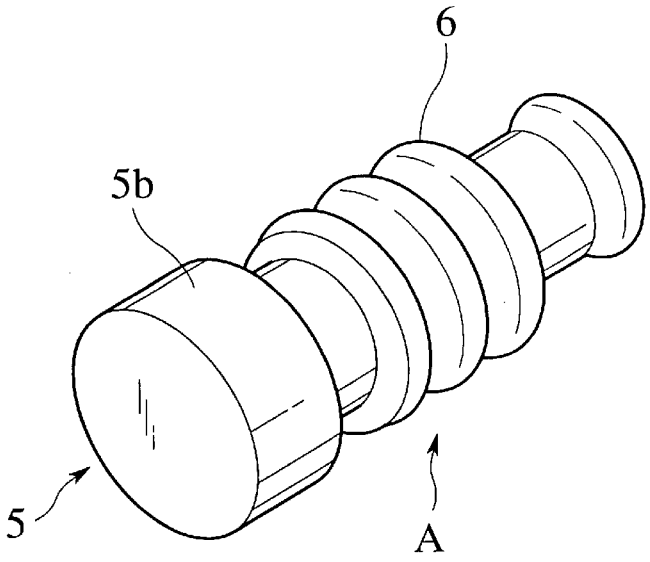
FIG.1 PRIOR ART
FIG. 1 is a perspective view of a conventional dummy tap for a waterproof connector.
Figure 2:
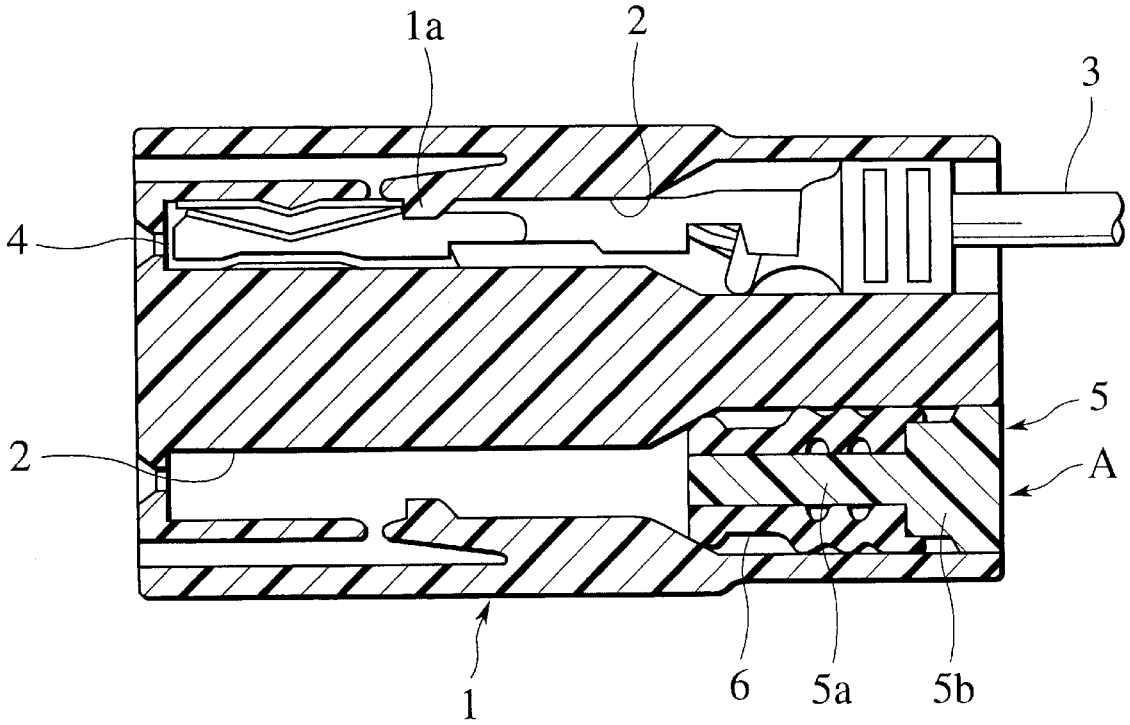
FIG.2 PRIOR ART
FIG. 2 is a sectional view of a waterproof connector using the conventional dummy tap.
Figure 3:
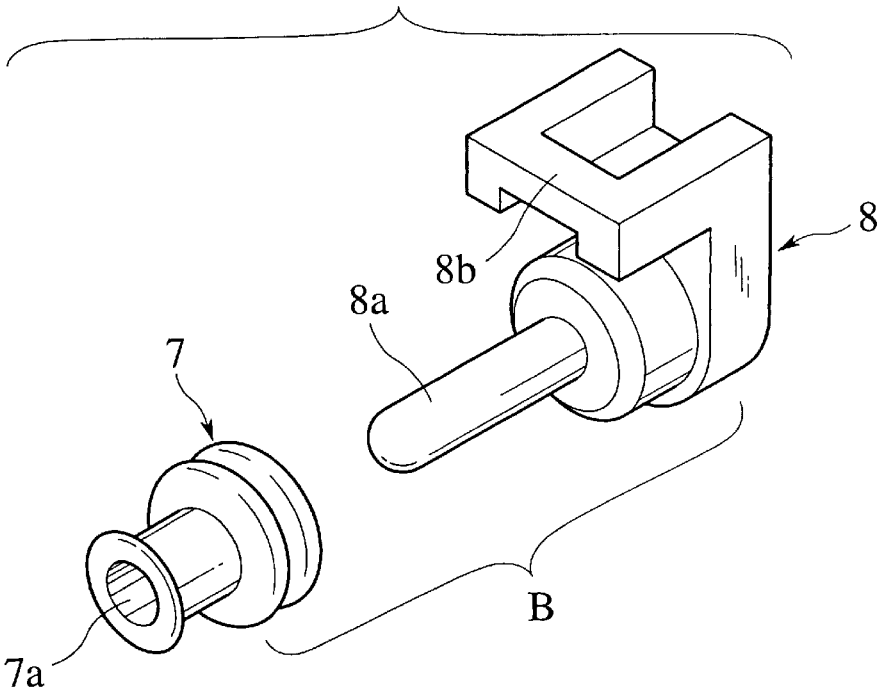
FIG.3 PRIOR ART
FIG. 3 is an exploded perspective view of another conventional dummy tap for a waterproof connector.
Figure 4:
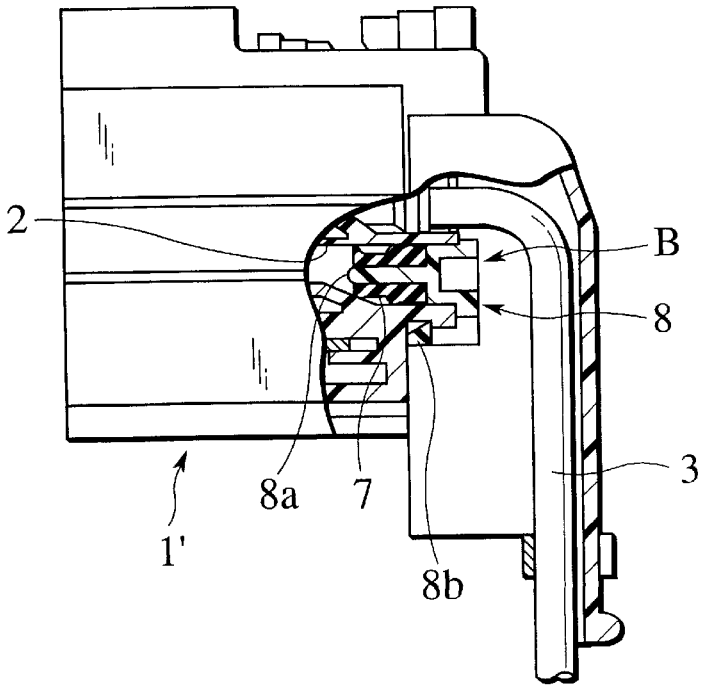
FIG.4 PRIOR ART
FIG. 4 is a side view showing a partial section of a waterproof connector using the another conventional dummy tap.

There will be detailed below the preferred embodiments of the present invention with reference to the accompanying drawings. Like members are designated by like reference characters.

Figure 5:
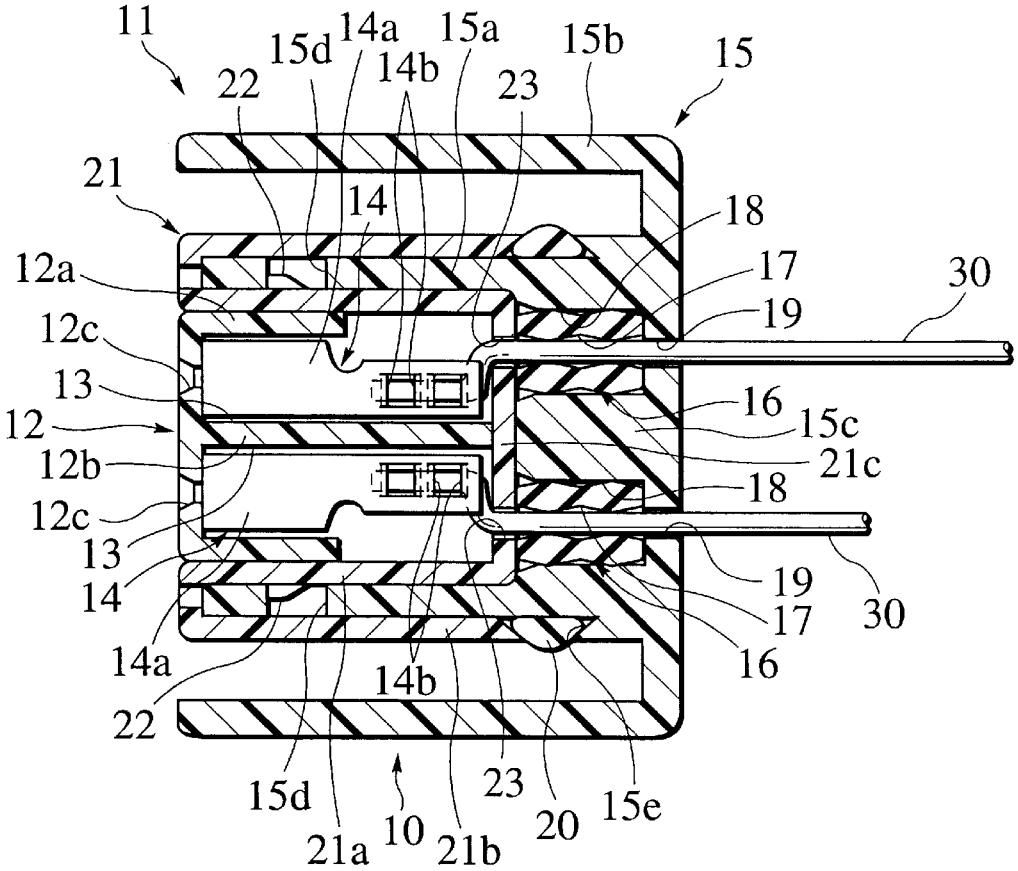
FIG. 5 is a sectional view showing a waterproof connector according to one embodiment of the present invention.
Figure 6:
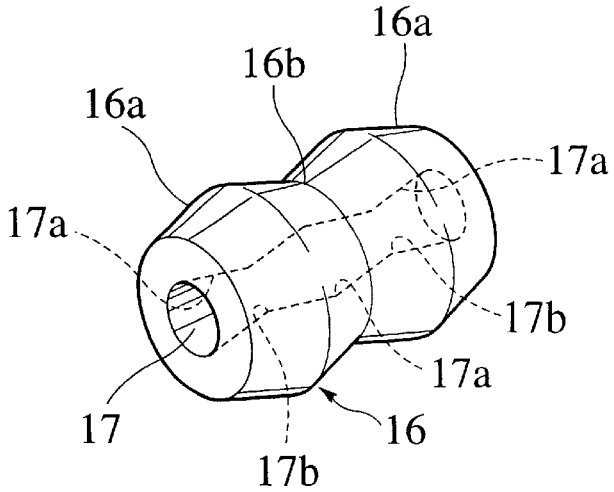
FIG. 6 is a perspective view of a rubber tap to be used for the waterproof connector.
Figure 7A:
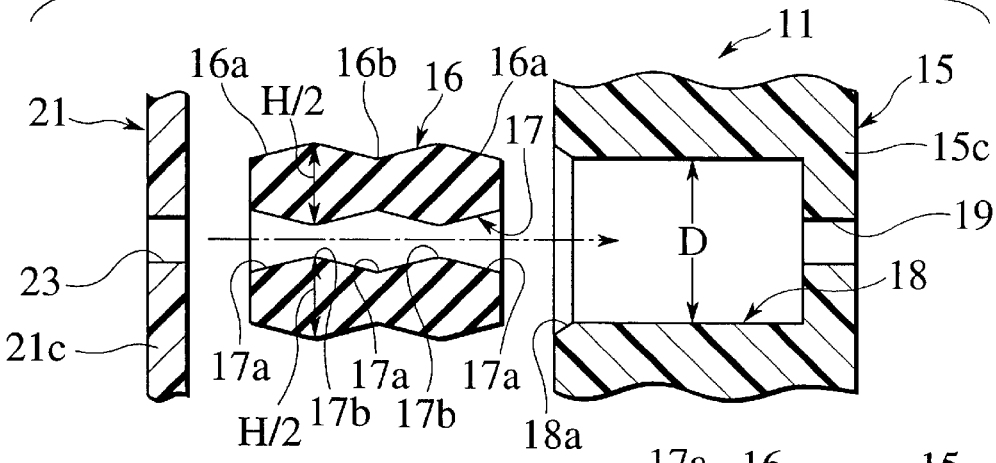
FIG. 7A is a partial enlarged section showing a state before the rubber tap is housed in a rubber tap housing concave section of the waterproof connector.
Figure 7B:
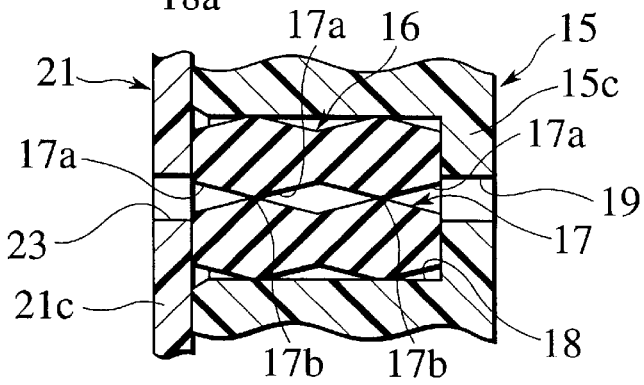
FIG. 7B is a partial enlarged section showing a state that the rubber tap is housed in the rubber tap housing concave section.
Figure 7C:
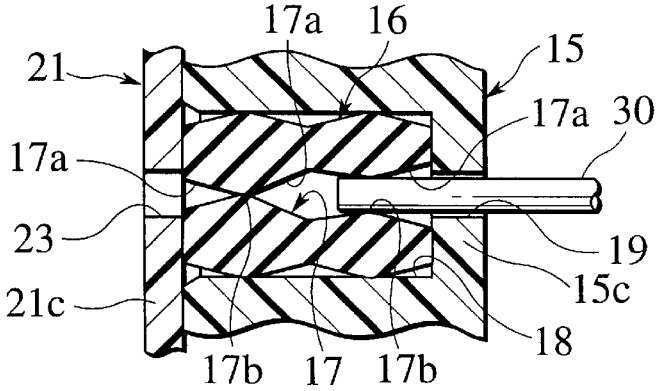
FIG. 7C is a partial enlarged section showing a state before an electric wire is inserted through an electric wire insertion hole of the rubber tap.
Figure 7D:
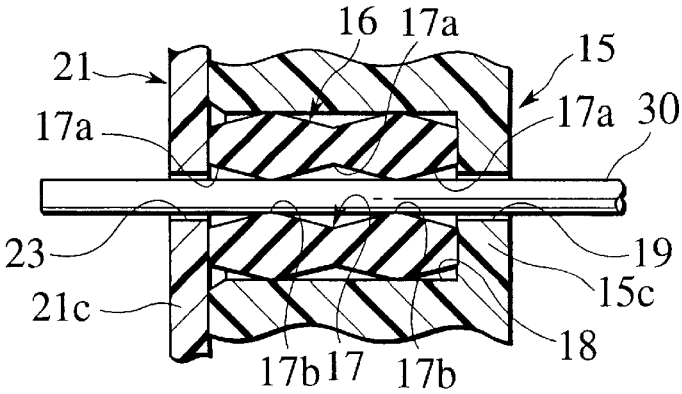
FIG. 7D is a partial enlarged section showing a state that the electric wire is inserted through the electric wire insertion hole.

FIG. 5 is a sectional view showing a waterproof connector according to one embodiment of the present invention, FIG. 6 is a perspective view of a rubber tap to be used for the waterproof connector, FIG. 7A is a partial enlarged section showing a state before the rubber tap is housed in a rubber tap housing concave section of the waterproof connector, FIG. 7B is a partial enlarged section showing a state that the rubber tap is housed in the rubber tap housing concave section, FIG. 7C is a partial enlarged section showing a state before an electric wire is inserted through an electric wire insertion hole of the rubber tap, and FIG. 7D is a partial enlarged section showing a state that the electric wire is inserted through the electric wire insertion hole.

As shown in FIG. 5, a connector housing 11 of a waterproof connector 10 is composed of an inner housing 12 made of synthetic resin which is formed integrally with a plurality of terminal housing chambers 13, an outer housing 15 made of synthetic resin into which the inner housing 12 is fitted, and a spacer 21 made of synthetic resin which intervenes between the inner housing 12 and outer housing 15 and holds female terminals (terminals) 14 housed in respective terminal housing chambers 13 of the inner housing 12.

As shown in FIG. 5, the inner housing 12 has a box section 12*a* in which upper and lower surfaces on a backward side are opened, and the terminal housing chambers 13 are formed in spaces which are formed by a center horizontal wall 12*b* and upper and lower vertical walls, not shown, which serve also as partition walls. The female terminals 14 are housed respectively in the terminal housing chambers 13. Here, rectangular insertion holes 12*c*, through which male terminals of a mating connector, not shown, are inserted, are formed in positions of a front wall of the box section 12*a* of the inner housing 12 which face the terminal housing chambers 13. Further, a pair of pressure-welded cutting edges 14*b*, 14*b* are formed to be bent on a plate of the box section 14*a* of the female terminal 14 on the backward side.

The outer housing 15 is formed into a double box shape by a substantially square-drum-shaped inner wall section 15*a*, a substantially square-drum-shaped outer wall section 15*b* which contains the inner wall section 15*a*, and a bottom wall section (one wall section) 15*c* which connects backward portions of the inner and outer wall sections 15*a* and 15*b* so that a front side of the outer housing 15 is opened. A center of the bottom wall section 15*c* is thick, and rubber tap housing concave sections 18 with a large diameter and circular section into which waterproof rubber taps 16 are pressedly inserted are formed respectively in positions of the thick portion on the front side facing the terminal housing chambers 13. Moreover, electric wire insertion holes 19 with a small diameter and circular section through which electric wires 30 are inserted are formed on the backward side of the thick portion so as to be interconnected with the corresponding rubber tap housing concave sections 18.

In addition, rectangular engagement holes (engagement sections) 15*d*, where engagement claws, not shown, on upper and lower surfaces of the box section 12*a* of the inner housing 12 are engaged/disengaged with/from are formed respectively at the centers of the upper and lower walls on the front side of the inner wall section 15*a* of the outer housing 15. Further, V-shaped packing receiving sections 15*e* which receive a circular waterproof packing 20 made of rubber are projected respectively from inward portions of the inner wall section 15*a* of the outer housing 15.

As shown in FIGS. 5, 6, 7A, 7B, 7C and 7D, the waterproof rubber tap 16 has an electric wire insertion hole 17 whose inner and outer peripheral surfaces have an uneven substantially cylindrical shape and through which the electric wire 30 is inserted without a gap. As detailed below, a circular concave section 17*a* having a dented section and a circular convex section 17*b* having a protruded section are alternatively formed integrally with the electric wire insertion hole 17 of the rubber tap 16. Compression margins or the like are set so that when the rubber taps 16 are pressedly inserted respectively into the rubber tap housing concave sections 18 of the outer housing 15, a pair of the circular convex sections 17*b* of the electric wire insertion holes 17 of the rubber taps 16 are blocked up (for example, when a thickness of the circular convex section 17*b* of the rubber tap 16 is H (H/2+H/2=H) and a diameter of the rubber tap housing concave section 18 is D, a relationship $H \geqq D$ is satisfied). Namely, as shown in FIGS. 7A and 7B, when the rubber taps 16 are pressedly inserted respectively into the rubber tap housing concave sections 18 of the outer housing 15, a pair of the circular convex sections 17*b* of the electric wire insertion holes 17 of the rubber taps 16 are blocked up, and as shown in FIGS. 7C and 7D, when the electric wires 30 are inserted through the electric wire insertion holes 17 of the rubber taps 16, on opening end inlet sides of the electric wire insertion holes 17, the circular convex sections 17*b* are spread out by guiding by reverse conical surfaces of the reverse conical and circular concave sections 17*a*.

Here, conical surfaces (tapered surfaces) 16*a*, 16*a* are formed on both ends of outer peripheral surface of the waterproof rubber tap 16, and a concave section 16*b* having a V-shaped section is formed on its center. Moreover, a reverse conical surface (taped surface) 18*a* is formed on an inlet side of the rubber tap housing concave section 18.

As shown in FIG. 5, the spacer 21 is formed into a box shape by a substantially square-drum-shaped body section 21*a* which is fitted into an inner side of the inner wall section 15*a* of the outer housing 15, a substantially square-drum-shaped collar section 21*b* which is formed integrally with a front end of the body section 21*a* so as to be bent backward and which is fitted into an outer side of the inner wall section 15*a* of the outer housing 15, and a bottom wall section (one wall section) 21*c* of the body section 21*a* so that a front side of the spacer 21 is opened.

The box section 12*a* of the inner housing 12 is fitted into the inner portion of the body section 21*a* of the spacer 21. Rib-shaped projections, not shown, for preventing the terminals from slipping off, which are engaged with backward ends of the box sections 12*a* of the inner housing 12 and backward ends of the box sections 14*a* of the female terminals 14 housed respectively in the terminal housing chambers 13, are projected integrally from the inner surfaces of the upper and lower walls of the body section 21*a* of the spacer 21. Moreover, engagement claws (engagement sections) 22 which are engaged/disengaged with/from the engagement holes 15*d* of the outer housing 15 are projected integrally from the outer surfaces of the upper and lower walls of the body section 21*a* of the spacer 21. Further, a forward end of the collar section 21*b* of the spacer 21 holds the packings 20 which are engaged with the packing receiving sections 15*e* of the inner wall section 15*a* of the outer housing 15 when fitting of the spacer 21 into the outer housing 15 is completed.

In addition, electric wire insertion holes 23 are formed respectively in positions of the bottom wall section 21*c* of the spacer 21 facing the respective electric wire insertion holes 19 of the outer housing 15. Further, the bottom wall section 21*c* of the spacer 21 holds the rubber taps 16 which are inserted respectively into the rubber tap housing concave sections 18 of the bottom wall section 15*c* of the outer housing 15 so as to be capable of preventing the rubber taps 16 from slipping off when the fitting of the spacer 21 into the outer housing 15 is completed. Then, as shown in FIG. 5, the electric wires 30, which are inserted through the electric wire insertion holes 19 of the outer housing 15, the electric wire insertion holes 17 of the rubber taps 16 and the electric wire insertion holes 23 of the spacer 21, are connected and pressure-welded between the pair of the pressure-welded cutting edges 14*b*, 14*b* of the female terminals 14 housed respectively in the terminal housing chambers 13 of the inner housing 12 so that the terminal housing chambers 13 and electric wires 30 are sealed by the rubber taps 16 and packings 20.

In the case where the waterproof connector 10 of the present embodiment is assembled, as shown in FIG. 7A, at first the rubber taps 16 are inserted to be set into the rubber tap housing concave sections 18 in the bottom wall section 15*c* of the outer housing 15 composing the outer side of the connector housing 11 from a connector housing fitting direction, and the packings 20 are inserted to be set into the packing receiving sections 15*e* of the inner wall section 15*a* of the outer housing 15. Thereafter, the body section 21*a* of the spacer 21 is fitted into the inner wall section 15*a* of the outer housing 15, and the engagement claws 22 of the body section 21*a* of the spacer 21 are engaged respectively with the engagement holes 15*d* of the inner wall section 15*a* of the outer housing 15. Since the engagement holes 15*d* of the inner wall section 15*a* of the outer housing 15 are engaged with the engagement claws 22 of the body section 21*a* of the spacer 21, removal of the rubber taps 16 is prevented by the bottom wall section 15*c* of the outer housing 15, and thus slipping off is prevented securely. Moreover, removal of the packings 20 is prevented by a slanted forward end of the collar section 21*b* of the spacer 21, and thus waterproofness of the whole connector housing is further improved.

Next, as shown in FIGS. 7C and 7D, the electrical wire 30 are inserted through the electric wire insertion holes 19 of the bottom wall section 15*c* of the outer housing 15 from the outside, and the electric wires 30 are inserted through the electric wire insertion holes 17 of the rubber tap and 23 of the bottom wall section 21*c* of the spacer 21 from the outside. The electric wires 30 are pressure-welded to and connected with the pair of the pressure-welded cutting edges 14*b*, 14*b* of the female terminals 14 housed respectively in the terminal housing chambers 13 of the inner housing 12 composing the inside of the connector housing 11. Next, the inner housing 12 is fitted into the body section 21*a* of the spacer 21, and the engagement claws, not shown, of the box section 12*a* of the inner housing 12 are engaged respectively with the engagement holes 15*d* of the inner wall section 15*a* of the outer housing 15 so that the assembly of the waterproof connector 10 is completed.

At this time, because of diversification of variation of application or the like of the waterproof connector 10 and because of common use of variation of a wire harness circuit, the wiring of the electric wires 30 is not required on some portions (portions where the wiring of the electric wires 30 is not required). However, since the female terminals 14 are previously housed respectively in the terminal housing chambers 13 of the inner housing 12 and the rubber taps 16 are previously inserted respectively into the rubber tap housing concave sections 18 of the outer housing 15, there is some fear that water penetrates the electric wire insertion holes 17 of the rubber tap 16 where the electric wire 30 is not wired. However, as shown in FIG. 7B, since the circular convex section 17*b* of the electric wire insertion hole 18 of the rubber tap 16 is pressedly inserted into the rubber tap housing concave section 18 of the outer housing 15 where the electric wire 30 is not wired is blocked up, the blocked-up circular convex section 17*b* securely prevents water from penetrating thereinto from the outside, and thus waterproofness of the rubber tap 16 where the electric wire 30 is not wired can be obtained securely.

In addition, even if wiring paths of the electric wires 30 are changed in the connector housing 11 (for example, the electric wire 30 is wired in a portion where wiring of the electric wire 30 is not required), as shown in FIG. 7C, the reverse conical and circular concave section 17*b* guides the insertion of the electric wire 30 through the electric wire insertion hole 17 on the opening end inlet side of the electric wire insertion hole 17 of the rubber tap 16, and thus the electric wire 30 can be inserted through the electric wire insertion hole 17 of the rubber tap 16 easily without replacing parts. Moreover, the waterproofness of the rubber taps 16 can be obtained easily and securely, and the diversification of the application or the like of the waterproof connector 10 can be further improved.

In such a manner, since when the rubber taps 16 are pressedly inserted into the rubber tap housing concave sections 18 of the outer housing 15, the circular convex sections 17*b*, 17*b* of the electric wire insertion holes 17 are blocked up and when the electric wires 30 are inserted through the electric wire insertion holes 17, the circular convex sections 17*b* on the opening end inlet side of the electric wire insertion holes 17 are spread out by the guiding by the reverse conical and circular concave sections 17*b*, a conventional dummy tap is not required, and thus a number of parts can be reduced and the cost can be lowered further. Particularly, since the conventional dummy tap is not required, the normal rubber tap 16 can be used and thus additional expense of metal mold and parts managing expenses are not necessary. From this point, the costs can be lowered. Moreover, since the spacer 21 which intervenes between the inner housing 12 and outer housing 15 holds the rubber taps 16, the slipping of the rubber taps 16 can be prevented securely, and reliability of the waterproofness can be further improved.

The above embodiments described the case where the electric wire is pressure-welded to and is connected with the pressure-welded terminal, but the terminal is not limited to the pressure-welded terminal, so needless to say, the above embodiments can be applied to a case where the electric wire contact-bonds and is connected with a contact-bonding terminal.

The entire contents of Japanese Patent Application P10-165552 (filed Jun. 12, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A waterproof connector for holding at least one terminal connected to an electrical wire, the connector comprising:

an outer housing having at least one rubber tap housing section formed therein, said at least one rubber tap housing section having an opening at one end and a first insertion hole at an opposite end;

a rubber tap inserted in said at least one rubber tap housing section through said opening, said rubber tap having a through hole for insertion of an electrical wire into an electrical terminal, said through hole aligning with said first insertion hole, said rubber tap having a normal diameter greater than the diameter of said at least one rubber tap housing section, whereby said through hole is sealed by radial compression of said rubber tap;

a spacer connected to said outer housing, said spacer holding said rubber tap within said at least one rubber tap housing section, said spacer having a second insertion hole in alignment with said through hole;

an inner housing connected to said spacer, said inner housing having at least one housing chamber for holding the electrical terminal, said at least one housing chamber aligned with said at least one rubber tap housing section, respectively, said spacer being capable of retaining the electrical terminal within said at least one housing chamber.

2. The waterproof connector of claim 1 further comprising a waterproof packing disposed between said outer housing and said spacer.

3. The waterproof connector of claim 1 wherein said through hole includes at least one constricting portion and at least one distending portion, whereby said constricting portion is closed when said rubber tap is held within said at least one rubber tap housing section.

4. The waterproof connector of claim 3 wherein said rubber tap having a thickness that varies along the length of said rubber tap, said thickness being larger at said at least one constricting portion than at said distending portion.

* * * * *